US011485929B2

(12) United States Patent
Bargon et al.

(10) Patent No.: US 11,485,929 B2
(45) Date of Patent: Nov. 1, 2022

(54) LUBRICANT FOR THE HOT FORMING OF METALS

(71) Applicant: Chemische Fabrik Budenheim KG, Budenheim (DE)

(72) Inventors: Marvin Bargon, Budenheim (DE); Steffen Bugner, Budenheim (DE); Clémence Longis, Frankfurt am Main (DE); Dirk Masurat, Eltville (DE); Nicole Weyer, Budenheim (DE)

(73) Assignee: Chemische Fabrik Budenheim KG, Budenheim (DE)

( * ) Notice: Subject to any disclaimer, the term of this patent is extended or adjusted under 35 U.S.C. 154(b) by 0 days.

(21) Appl. No.: 17/310,710

(22) PCT Filed: Feb. 21, 2020

(86) PCT No.: PCT/EP2020/054621
§ 371 (c)(1),
(2) Date: Aug. 18, 2021

(87) PCT Pub. No.: WO2020/169800
PCT Pub. Date: Aug. 27, 2020

(65) Prior Publication Data

US 2022/0162517 A1 May 26, 2022

(30) Foreign Application Priority Data

Feb. 22, 2019 (DE) ..... 10 2019 104 540.1

(51) Int. Cl.
*C10M 173/02* (2006.01)
*C10N 30/00* (2006.01)
(Continued)

(52) U.S. Cl.
CPC .... *C10M 173/02* (2013.01); *C10M 2201/103* (2013.01); *C10M 2201/12* (2013.01);
(Continued)

(58) Field of Classification Search
CPC ..... C10M 173/02; C10M 2205/022; C10M 2209/062; C10M 2201/102;
(Continued)

(56) References Cited

U.S. PATENT DOCUMENTS 2,956,019 A 10/1960 Sand et al.
4,052,323 A * 10/1977 Feneberger ..... C10M 125/24 508/130
(Continued)

FOREIGN PATENT DOCUMENTS

CN 101535459 A 9/2009
CN 102732367 A 10/2012
(Continued)

OTHER PUBLICATIONS

Database WPI Week 201809 Thomson Scientific, London, GB; AN 2018-01826J, XP002798808.
(Continued)

*Primary Examiner* — Vishal V Vasisth
(74) *Attorney, Agent, or Firm* — Faegre Drinker Biddle & Reath LLP

(57) ABSTRACT

A lubricant for the hot forming of metals, with respect to the solid constituents, contains at least the following constituents:

55 to 85 wt % of a solid lubricating agent comprising a mixture of talc and a potassium mica, wherein the ratio of talc to potassium mica in the solid lubricating agent is 2.0 to 5.0, 10 to 30 wt % of an adhesive agent selected from a polyvinyl acetate, sodium water glass and dextrin or a mixture of same, 2 to 10 wt % of a thickener selected from hydroxy cellulose, hydroxyethyl cellulose, hydroxyproply cellulose, carboxymethyl cellulose, methyl cellulose,
(Continued)

Friction values of the compositions A – H and the reference PH120 ethyl cellulose, methylethyl cellulose, hydroxyethylmethyl cellulose, hydroxypropylmethyl cellulose, ethylhydroxymethyl cellulose, carboxymethylhydroxy cellulose, dextrin, starch, organically modified bentonite, smectite and xanthan gum, 0 to 10 wt % of further auxiliary agents, and not more than 10 wt % of graphite.

13 Claims, 2 Drawing Sheets

(51) Int. Cl.

| | |
|---|---|
| *C10N 40/20* | (2006.01) |
| *C10N 30/04* | (2006.01) |
| *C10N 30/16* | (2006.01) |
| *C10N 30/18* | (2006.01) |

(52) U.S. Cl.
CPC . *C10M 2209/062* (2013.01); *C10M 2209/126* (2013.01); *C10N 2030/04* (2013.01); *C10N 2030/16* (2013.01); *C10N 2030/18* (2013.01); *C10N 2030/40* (2020.05); *C10N 2040/241* (2020.05); *C10N 2040/242* (2020.05)

(58) Field of Classification Search
CPC .... C10M 2201/1026; C10M 2201/103; C10M 2209/126; C10N 2010/02; C10N 2010/06; C10N 2010/08; C10N 2040/20; C10N 2040/24; C10N 2040/242
See application file for complete search history.

(56) References Cited

U.S. PATENT DOCUMENTS

| | | | | |
|---|---|---|---|---|
| 6,169,059 | B1 * | 1/2001 | Skiles | C10M 129/08 508/156 |
| 2009/0305918 | A1 | 12/2009 | Bugner et al. | |
| 2013/0008216 | A1 | 1/2013 | Saitou | |
| 2014/0148369 | A1 | 5/2014 | Tang et al. | |
| 2016/0075903 | A1 | 3/2016 | Miller-Jupp et al. | |
| 2018/0155651 | A1 | 6/2018 | Oshita et al. | |
| 2018/0355275 | A1 | 12/2018 | Oshita et al. | |

FOREIGN PATENT DOCUMENTS

| | | | |
|---|---|---|---|
| CN | 102753666 | A | 10/2012 |
| CN | 104059740 | A | 9/2014 |
| CN | 104694240 | A | 6/2015 |
| CN | 106334713 | A | 1/2017 |
| CN | 107523386 | A | 12/2017 |
| CN | 107614666 | A | 1/2018 |
| CN | 107969134 | A | 4/2018 |
| DE | 10 2004 045 128 | A1 | 3/2006 |
| EP | 3305882 | A1 | 4/2018 |
| JP | 2003-313573 | A | 11/2003 |
| JP | 2005-220267 | A | 8/2005 |
| WO | WO-2006/029934 | A3 | 12/2006 |

OTHER PUBLICATIONS

Database WPI Week 201321 Thomson Scientific, London, GB; AN 2013-B00909 XP002798809.
First Chinese Office Action issued in Chinese patent application No. 202080015980.6 dated Apr. 29, 2022.

* cited by examiner

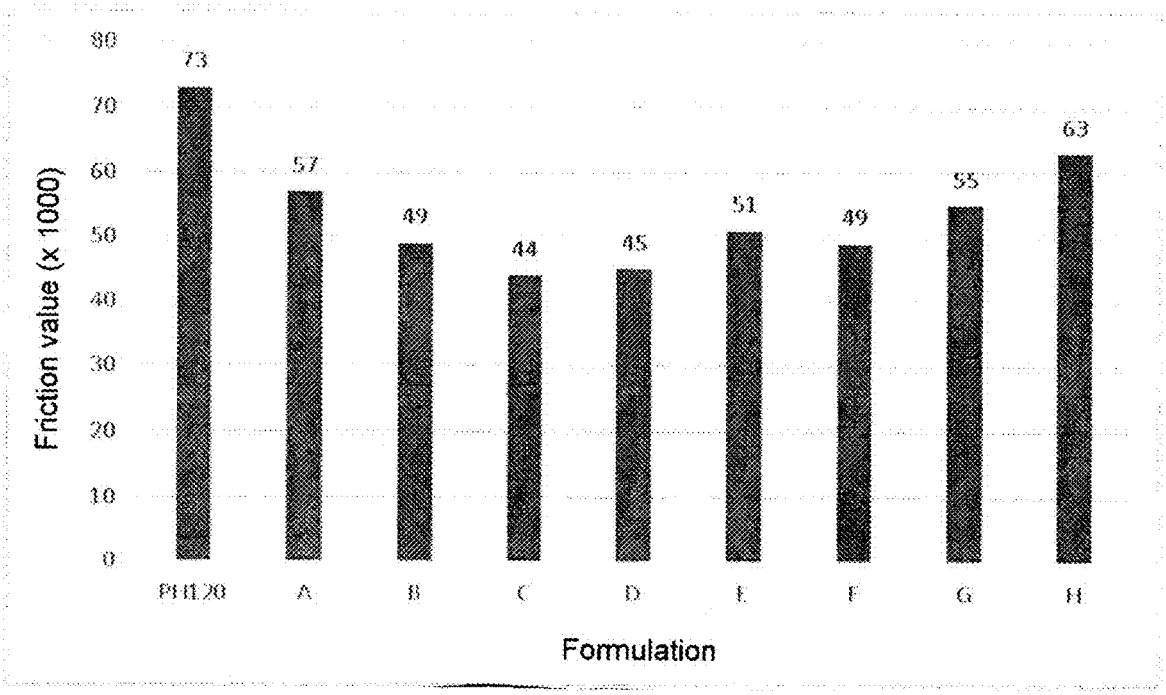
Fig. 1: Friction values of the compositions A – H and the reference PH120
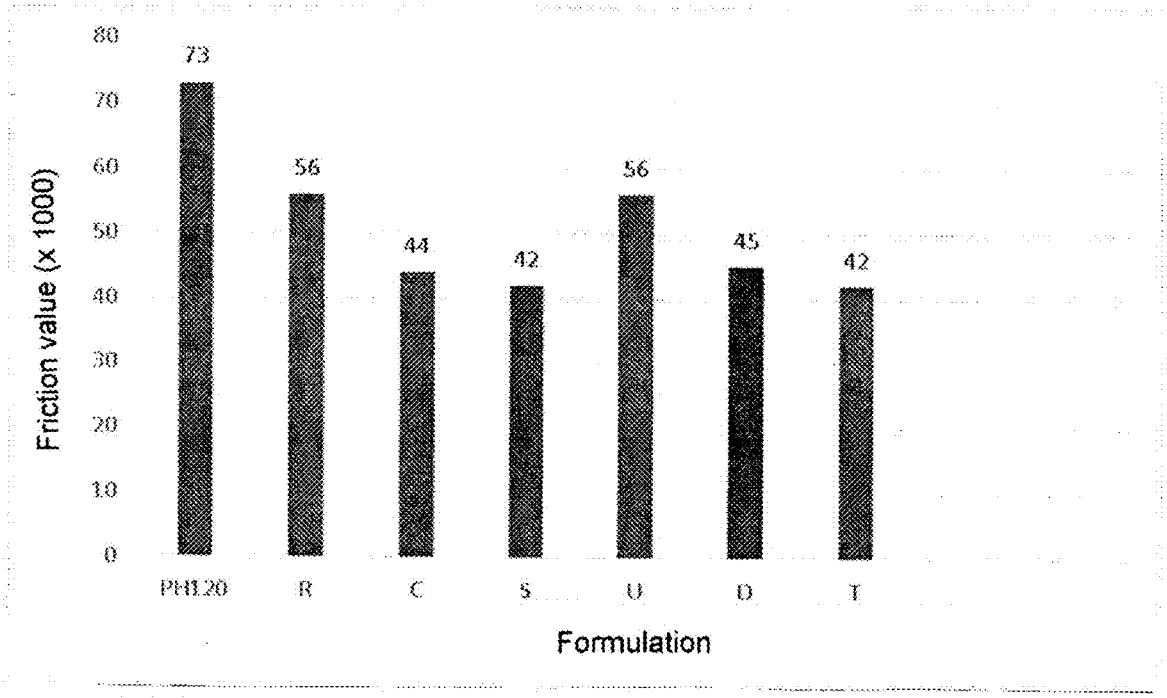
Fig. 2: Friction values of the compositions R, C, S, U, D, T and the reference PH120

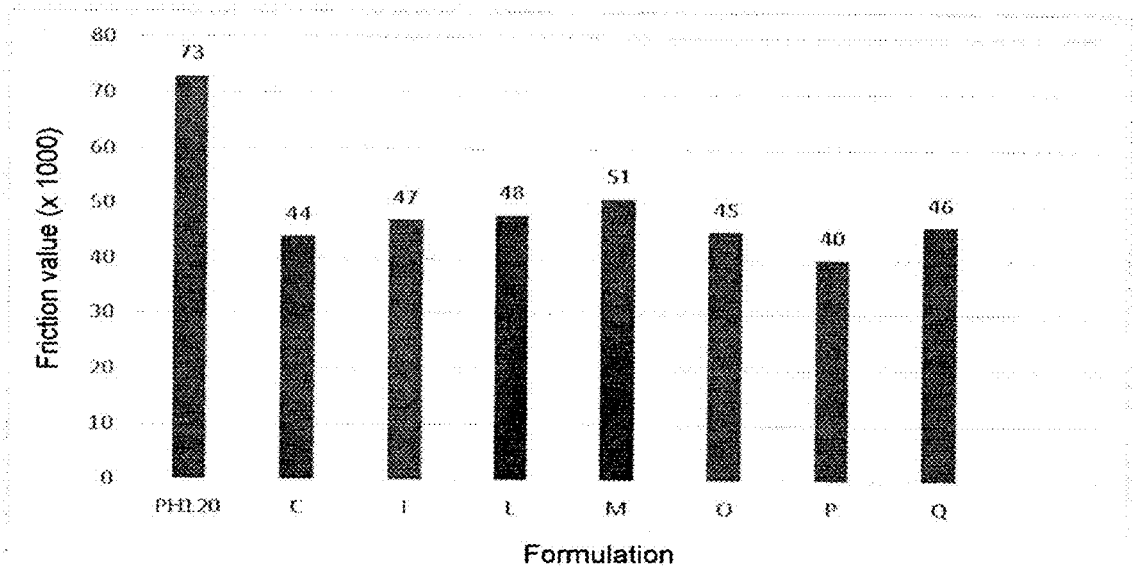
Fig. 3: Friction values of the compositions C, I, L, M, O, P, Q and the reference PH120
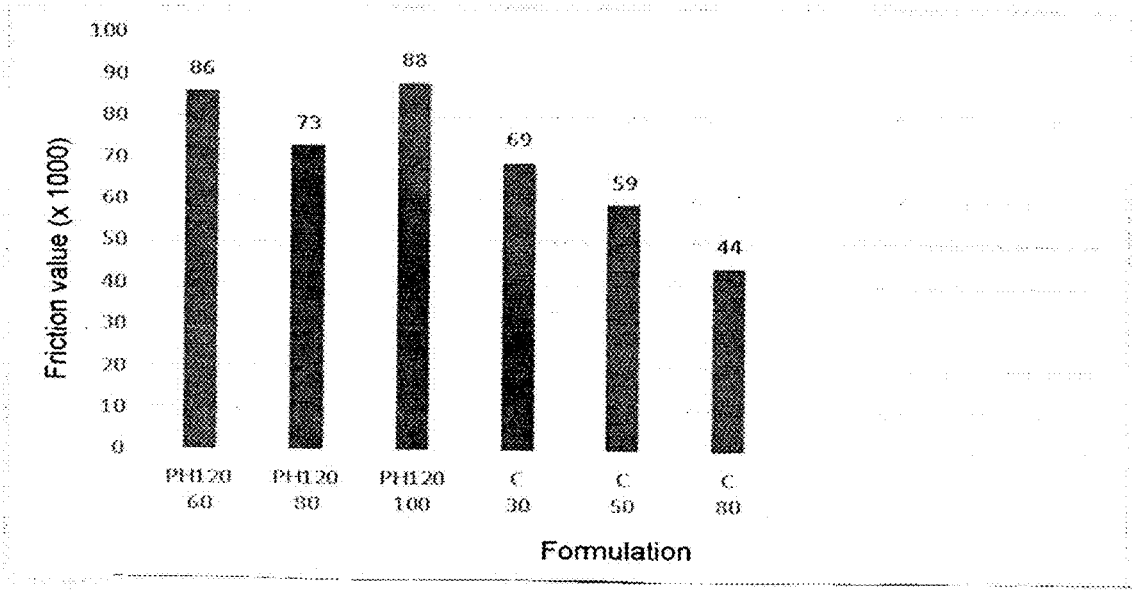
Fig. 4: Friction values of PH120 and the composition C with different layer thicknesses

LUBRICANT FOR THE HOT FORMING OF METALS

CROSS REFERENCE TO RELATED APPLICATIONS

This application is a National Stage of International Application No. PCT/EP2020/054621 filed Feb. 21, 2020, which claims benefit of German Patent Application No. 10 2019 104 540.1 filed Feb. 22, 2019, both of which are herein incorporated by reference in their entirety.

SUBJECT-MATTER OF THE INVENTION

The invention concerns a substantially graphite-free and boron-free mandrel bar lubricant for use in the hot forming of metals for the production of seamless tubes, in particular in so-called continuous processes or push bench processes.

BACKGROUND OF THE INVENTION

In the hot forming of metals like for example sheets or hollow blocks, in rolling or pressing installations, lubricants are required, which ensure optimum sliding movement of the metal between the processing tools at high processing temperatures. In that respect, temperatures of 1100 to 1300° C. can occur in the production of profiled sheets or seamless tubes in rolling installations. When metals which are hard or difficult to shape are being processed that can result in rapid wear of the processing tools. In addition high frictional values between tool and workpiece lead to increased energy consumption in the processing operation.

In modern tube rolling plants, in particular in the so-called continuous process with a plurality of driven and separately controlled rolling stands forming of seamless tubes is effected in the main process step by rolling a prefabricated hollow block at about 1200° C. to 1300° C. by way of a mandrel bar. After the rolling operation the mandrel bar is removed from the rolled tube blank and cooled in a cooling bath or by spray cooling with water and prepared for the next rolling operation. That preparation of the mandrel bar after cooling also includes lubrication in which the lubricant is sprayed on to the mandrel bar.

Such lubrication is essential for optimum sliding movement of the hollow block on the mandrel bar during the rolling operation and is also decisive in terms of the later quality and dimensional accuracy of the tube, in particular in regard to the nature of the inside surface of the tube.

The mandrel bar lubricants used must afford good lubrication properties and at the same time withstand the high processing temperatures. The good lubrication properties not only include the lubricants being suitable for reducing the frictional value between the mandrel bar but also having good wetting properties and producing a lubricant film which is as continuous as possible and of adequate layer thickness on the mandrel bar.

In some cases the lubricants contain additives which in addition reduce the formation of scale at the surface of the material being processed, like for example boron compounds, for example boric acid salts which by virtue of their water solubility can pass into the waste water from the rolling operation, which however leads to serious disposal problems because of their teratogenic action.

Known lubricants can be subdivided into graphite-bearing and graphite-free lubricants. Graphite-free lubricants are also referred to as "white" lubricants as they are not coloured by the strong intrinsic colour of graphite.

Graphite is a suitable lubricant additive precisely in relation to high-temperature applications like the hot forming of metals because graphite is particularly heat-resistant and itself and in combination with mineral oils and inorganic salts has particularly good lubrication properties. A disadvantage of graphite-bearing lubricants is that carburisation of the metal surface of the workpiece can occur by virtue of the high proportion of carbon. In that case defective end products with poor material properties and poor properties in terms of further processing can ensue. The result is a high workpiece rejection rate. In addition the use of graphite in the working environment encounters health objections which make it necessary to provide particularly complicated and expensive protective measures for the people working in the working environment.

A group of lubricants which can be both graphite-bearing and also graphite-free contain salts or salt mixtures which melt on the hot surface of the workpiece and by virtue of the melt form a lubricating separating layer between workpiece and tool. Only certain salts however are suitable for that purpose and some of those have such high melting temperatures that the lubricants are fully capable of use only when the operating temperature is reached. That is particularly disadvantageous when starting up the processing machines because the tools or workpieces are still cold. In some lubricants borax is used as a low-melting point salt. Besides the above-mentioned disadvantages of water-soluble boron compounds workpiece and tool can also stick together when using borax-bearing lubricants, with the result that damage occurs on the tool or the machines come to a stop. In addition borax-bearing lubricants detrimentally attack the metal surface of tool or workpiece.

Further known lubricants use rough common salt, which however in relation to the workpiece can lead to material ablation and material deposit at another location and thus give rise to scoring. In addition common salt results in increased metal corrosion on the installations, which results in high maintenance costs. Even water-soluble lubricants on the basis of alkali phosphates and alkali borates which are also used in a mixture with various metal oxides like zinc oxide or iron oxide attack the surface of the material to be processed.

A further group of high-temperature lubricants contain alkali phosphate glasses or silicate glasses with various additives like boron or aluminium. Those lubricants have good lubrication properties but are poorly water-soluble, which makes it considerably more difficult to remove them from the processed workpiece and requires a high level of technical implementation.

Particularly in the production of seamless tubes in the continuous process mandrel bar lubricants with a high proportion of graphite are still predominantly used because of the high demands on lubricating properties and temperature resistance. Graphite-free or low-graphite ("white") mandrel bar lubricants in that case are scarcely used in spite of the above-described and further disadvantages. Lubricants suitable for that purpose are costly and require the use of large amounts, which has a detrimental effect on the manufacturing costs and thus on the costs of the product.

CN-A-104 694 240 discloses a graphite-free lubricant composition which contains 10-90 wt % mineral clay, 0-5 wt % stearate, 0.1-5 wt % of a thickener, preferably sodium polyacrylate, 5-30 wt % water-soluble borate and/or boric acid and further additives like surface-active substances and polymers.

CN-A-102 732 367 discloses a graphite-free lubricant composition which contains 15-20 wt % glass powder, 2.5-8 wt % of a white solid lubricant, 0.5-3.5 wt % of a thickener and further additives like surface-active substances and resins. The white solid lubricant includes one or more compounds from the group consisting of mica, talc and boronitride. Gelatins or celluloses are used as thickeners.

The known lubricating agents for the hot forming of metals accordingly have a series of disadvantages by virtue of and in dependence on their respective composition, like health and environmental hazards and related thereto necessary protective measures, a high consumption by virtue of the high levels of required amounts for use, high costs of the constituents of the compositions, detrimental friction values, disadvantageous effects on the processing process and/or the properties of the product manufactured like sticking or welding of tool and workpiece, carburisation or other forms of damage to the workpiece surface, disadvantageous wetting properties and/or disadvantageous layer thicknesses.

OBJECT OF THE INVENTION

The object of the present invention is therefore that of providing a mandrel bar lubricant which overcomes the disadvantages of the state of the art and which is suitable in particular as a mandrel bar lubricant for the hot forming of metals in the manufacture of seamless tubes in continuous processes or push bench processes and which, in comparison with the graphite-based lubricants used hitherto in those processes, contains no or at most a very small amount of graphite, has good friction values and good wetting properties, and in comparison with known lubricants in the same application requires lower amounts for use and/or can be produced at lower cost.

DESCRIPTION OF THE INVENTION

That object is attained by a lubricant for the hot forming of metals, in particular for lubricating the mandrel bar and/or the hollow block in the production of seamless tubes, wherein the lubricant, with respect to the solid constituents, contains at least the following constituents:

55 to 85 wt % of a solid lubricating agent comprising a mixture of talc and a potassium mica, preferably phlogopite, muscovite or a mixture of both, particularly preferably phlogopite, wherein the ratio of talc to potassium mica in the solid lubricating agent is 2.0 to 5.0, 10 to 30 wt % of an adhesive agent selected from a polyvinyl acetate, sodium water glass and dextrin or a mixture of same, preferably ethylene vinylacetate copolymer (EVA), 2 to 10 wt % of a thickener selected from hydroxy cellulose, hydroxyethyl cellulose, hydroxyproply cellulose, carboxymethyl cellulose, methyl cellulose, ethyl cellulose, methylethyl cellulose, hydroxyethyl methyl cellulose, hydroxypropyl methyl cellulose, ethylhydroxymethyl cellulose, carboxymethylhydroxy cellulose, dextrin, starch, organically modified bentonite, smectite and xanthan gum, preferably xanthan gum, 0 to 10 wt % of further auxiliary agents, preferably selected from anti-foaming agent, dispersing agent and biocide, and not more than 10 wt % of graphite, preferably not more than 5 wt % graphite, particularly preferably no graphite.

An essential advantage of the lubricant according to the invention is that, in particular in the production of seamless tubes in continuous processes or push bench processes, it has very good friction values and wetting properties which, with identical or smaller layer thicknesses or amounts used, are comparable to those of graphite-bearing lubricants which are used at the present time in those processes, or are even superior thereto. The lubricant according to the invention can therefore replace the graphite-bearing lubricants used hitherto in continuous processes or push bench processes and at the same time can save on costs, disposal outlay and problems and the expenditure on working protection measures. Preferably the lubricant according to the invention contains not more than 5 wt % boron-bearing compounds, particularly preferably no boron-bearing compounds like boric acid, borax, boric acid salts or borate-containing minerals which are frequently used in known lubricants for the hot forming of metals. The lubricant according to the invention can therefore overcome the disadvantages of graphite-based and boron-bearing lubricants.

Application:

In the production of seamless tubes in continuous processes or push bench processes the lubricant is sprayed in the form of an aqueous suspension for preparation of the following rolling step on to the cooled mandrel bar, in which case however the mandrel bar is still at a temperature of the order of magnitude of about 100° C. An essential point of view for good lubricating performance of the lubricant in that case is complete continuous wetting of the mandrel bar and in particular the thickness of the layer of lubricant on the wetted mandrel bar. The lubricant according to the invention is distinguished by good adhesion on the mandrel bar and good uniform wetting of the surface of the mandrel bar. At the same time the amount of lubricant used or the layer thickness required for good lubrication in those processes is equal to or even less than graphite-bearing lubricants used in those processes at the present time.

When reference is made herein to the layer thickness or the use amount of the lubricant this denotes the solid amount of the lubricant on a given surface area of the tool, that is to say the mandrel bar, measured in grams of solid of the lubricant per square metre [$g/m^2$]. A suitable layer thickness for the lubricant according to the invention is of the order of magnitude of about 30 to 150 $g/m^2$ surface area of the mandrel bar, preferably 50 to 120 $g/m^2$, particularly preferably 70 to 100 $g/m^2$, depending on the respective composition of the lubricant.

Wetting of the surface of the mandrel bar and the layer thickness can be set by the amount of lubricant suspension sprayed on to the surface of the mandrel bar or the spray duration and by the viscosity and adhesion of the suspension. It has been found that the same or better lubricating effect can be achieved with the lubricant according to the invention in comparison with commercially usual graphite-bearing lubricants for the same purpose of use with the same or even smaller layer thickness or use amount. In that way it is possible to save on considerable costs in the production of seamless tubes in comparison with graphite-bearing lubricants used at the present time. At the same time further disadvantages of graphite-bearing lubricants are overcome like the particular working protection measures required when dealing with graphite-bearing lubricants, point welding of tool and workpiece as well as carburisation and the embrittlement caused thereby of the material at the inside surfaces of the rolled tubes.

An essential feature of the lubricant according to the invention is the proportion of solid lubricating agent which is a mixture of talc and potassium mica and wherein the ratio of talc to potassium mica is at least 2.0 and does not exceed 5.0.

In an advantageous embodiment of the invention the ratio of talc to potassium mica in the solid lubricating agent is 2.5 to 4.5, preferably 3.0 to 4.0 and particularly preferably 3.3 to 3.8.

Talc

Talc which according to the invention is one of the main constituents of the solid lubricating agent in the lubricant according to the invention is the powdered form of the mineral talc, a layered silicate (phyllosilicate), more precisely magnesium silicate hydrate. Depending on the respective modification it crystallises as talc-1A in the triclinic or talc-2M in the monoclinic crystal system.

Potassium Mica

Potassium micas which according to the invention form the further main constituent of the solid lubricating agent in the lubricant according to the invention but are contained in a smaller amount than talc are also layered silicates (phyllosilicates) which however have a potassium ion.

Basically the use of layered silicates in lubricants, also those for the hot forming of metals, was known. It was however surprising that it is precisely the combination of talc and potassium mica in the ratio claimed herein that contributes substantially to the improved and particularly advantageous properties of the lubricating agent according to the invention.

According to the invention suitable potassium micas include micas:

- muscovite-celadonite series (dioctahedral), specifically muscovite, $K\ Al_2[AlSi_3O_{10}(OH)_2]$, aluminoceladonite, $K\ Al(Mg, Fe^{2+})\ [Si_4O_{10}(OH)_2]$, ferro-aluminoceladonite, $K\ Al(Mg, Fe^{2+})\ [Si_4O_{10})(OH)_2]$, celadonite, $K\ Fe^{3+}(Mg, Fe^{2+})\ [Si_4O_{10}(OH)_2]$ ferroceladonite, $K\ Fe^{3+}(Mg, Fe^{2+})\ [Si_4O_{10}(OH)_2]$
- the phlogopite-annite series (trioctahedral), specifically annite, $K\ Fe^{2+}{}_3[AlSi_3O_{10}(OH)_2]$, phlogopite $K\ Mg^{2+}{}_3\ [AlSi_3O_{10}(OH)_2]$,
- the siderophylite-polylithionite series (trioctahedral), namely siderophylite, $K\ Fe^{2+}{}_2Al\ [Al_2Si_2O_{10}(OH)_2]$, polylithionite, $K\ Si_2\ Al[Si_4O_{10}F_2]$,
- the tainiolite group, tainiolite, $K\ Li\ Mg_2\ [Si_4O_{10}F_2]$,
- and mixtures of the above-mentioned potassium micas.

Phlogopite and muscovite, in particular phlogopite, have proven to be particularly advantageous. In a further embodiment of the invention in the solid lubricant of the lubricant according to the invention therefore the potassium mica contains at least 60 wt % phlogopite, preferably at least 80 wt % phlogopite, particularly preferably at least 90 wt % phlogopite. Quite particularly preferably only phlogopite is used as the potassium mica.

In the hot forming of metals, in particular for the lubrication of the mandrel bar and/or the hollow block in the production of seamless tubes, the lubricant according to the invention is sprayed in the form of a suspension of the solid constituents in water on to the mandrel bar, possibly also the hollow block. An aqueous suspension with 10 to 45 wt % solid constituents, preferably 15 to 35 wt % solid constituents, particularly preferably 20 to 30 wt % solid constituents, is suitable.

Besides the main constituent of the solid lubricating agent of talc and potassium mica the lubricant according to the invention further includes 10 to 30 wt % of an adhesive agent and 20 to 10 wt % of a thickener. Ethylene vinylacetate copolymer (EVA) has proven to be particularly advantageous as the adhesive agent and xanthan gum has been found to be particularly advantageous as the thickener. Other suitable adhesive agents and thickeners as are referred to herein can however also be used. Within the above-mentioned quantitative ranges, in each case in relation to the solid constituent of the lubricant, the man skilled in the art can easily ascertain the amounts of adhesive agent and thickener which are suitable for the overall composition of the lubricant, in order to achieve for the respective situation of use good processing capability, usability of the lubricant suspension in the respective available spray installation, wetting, adhesion and layer thickness formation on the tool surface.

The lubricant according to the invention further contains 0 to 10 wt % of further auxiliary agents which can be used in lubricants of the kind referred to herein advantageously and depending on the respective situation of use. Such auxiliary agents include preferably anti-foaming agents, dispersing agents and biocides.

Anti-foaming agents are intended to prevent or at least reduce disadvantageous foaming when spraying the lubricating suspension on to the tool, for example the mandrel bar. Suitable anti-foaming agents include polyglycols, amorphous and/or hydrophobic silicic acid, polysiloxanes, demethylpolysiloxanes, organically modified polysiloxanes and naphthalene condensates.

Dispersing agents can advantageously be used to improve the distribution of the solids of the lubricant in the aqueous suspension and to prevent or retard sedimentation of the solids in the suspension. Suitable dispersing agents include C16-C18 alcohols, ethoxylate salts, sodium and potassium tripolyphosphates, polyethylene glycol, and sodium silicate.

Biocides can advantageously be used to prevent or at least deter the increase of microorganisms like bacteria, fungi and/or yeasts in the lubricant, in particular upon prolonged storage of the lubricant. Suitable biocides include 1,2-benzisothiazol-3(2H)-one, 5-chloro-2-methyl-4-isothiazolin-3-one, 2-methyl-2H-isothiazol-3-one, 2-octyl-2H-isothiazol-3-one, ethylene dioxy dimethanol, tetrahydro-1,3,4,6-tetrakis(hydroxymethyl)imidazo[4,5-d]imidazol-2,5(1H,3H)-dione, 2-bromo-2-nitropropane-1,3-diol, 2,2-dibromo-2-carbamoylacetonitrile, sodium hypochlorite and sodium chlorite.

A further advantage of the lubricant according to the invention is that it can replace graphite-based lubricants used at the present time in continuous processes and push bench processes for the production of seamless tubes and can thus overcome the disadvantages in using graphite. Nonetheless graphite is an excellent lubricant and is particularly suitable in the hot forming of metals by virtue of its heat resistance. The graphite-based lubricants used hitherto for those applications therefore usually contain high proportions of graphite.

Even if the lubricant according to the invention is intended to overcome the disadvantages of graphite-bearing lubricants and to replace same it can be advantageous in embodiments of the lubricant according to the invention to add a certain amount of graphite to adjust the properties of the lubricant and further improve them. According to the invention however the proportion of graphite in the lubricant may not be more than 10 wt % graphite, preferably not more than 5 wt % graphite. Such a proportion of graphite in the lubricant according to the invention however is markedly less than the high graphite proportion in graphite-bearing lubricants used hitherto and therefore also does not involve the disadvantages of graphite to the known extent. Particularly preferably however the lubricant according to the invention does not contain any graphite.

The invention further concerns the use of the lubricant composition according to the invention for lubrication of the mandrel bar and/or the hollow block in the production of seamless tubes by hot forming of metals, preferably using the continuous process or the push bench process. In that respect the lubricant is desirably in the form of an aqueous suspension sprayed on to the mandrel bar which is at a temperature of about 100° C. before it is introduced into the hollow block.

Depending on the respective composition the lubricant according to the invention is sprayed in a layer thickness (use amount) of 30 to 150 g/m$^2$ surface area of the mandrel bar. Preferably the layer thickness (use amount) is 50 to 120 g/m$^2$ sprayed surface area, particularly preferably 70 to 100 g/m$^2$ sprayed surface area.

The invention is further described hereinafter by means of examples and the description of methods and materials used. The examples however are not to be interpreted as restrictive on the scope of protection of the invention.

Material and Methods

Viscosity Measurement

Viscosity measurements were carried out with a rotational rheometer R/S Plus from Brookfield (AMETEK GmbH-BU Brookfield, Lorch, Germany) with a coaxial cylinder (40 mm spindle) in accordance with DIN 53019 and in accordance with the manufacturer instructions and using the software Rheo3000 at a sample temperature of 20° C.+/−0.4° C.

Friction Value Measurements

Friction value measurements were carried out with the tribometer "HT-Tribometer Prüfstand 564" from Lohrentz GmbH Prüftechnik, Nidda-Harb, Germany. The tribometer comprises an inductively heatable rotating disc of Thermudur 2342 EFS steel of a diameter of 280 mm and a table which is displaceable hydraulically in the direction of the rotating disc and on which a test body of S355MC steel heatable by means of resistance heating is mounted.

For the friction value measurements the rotating disc was heated to 100° C. (±10° C.) and sprayed with the lubricant to the desired layer thickness. The spacing of the spray nozzle from the disc surface was 10 mm. Unless something different is expressly stated the lubricant was applied in a layer thickness of 80 g/m$^2$ and was allowed to act prior to measurement for about 5 seconds.

In the subsequent measurement the disc was rotated at 10 rpm. The test body was heated to 1230° C. (±20° C.), pressed by means of the hydraulically displaceable table with a pressing force (FN) of 32,000 N (±2,000 N) against the rotating disc and the radial force (FR) acting at the disc perpendicularly to the pressing force was measured over a period of several seconds. The friction value (μ) is the quotiant of the radial force (FR) and the pressing force (FN), μ=FR/FN. Six measurements were performed with each sample (6 fold determination). In each case the mean value of the detected friction values in the period of 2 to 6 seconds after contact of the workpiece with the rotating disc was viewed as the friction value of a measurement. The friction value specified herein is in turn the mean value from the six measurements carried out with each sample.

Layer Thickness Inspection

The layer thickness of a lubricant applied to the disc of the tribometer under the spray conditions (spray duration) was inspected by a procedure whereby, prior to spraying the lubricant, a magnetic strip foil was applied to the surface of the disc and the lubricant was then sprayed on. The magnetic strip foil was removed, weighed with the lubricant applied thereto, and the layer thickness was determined from the difference in relation to the weight of the foil not bearing the lubricant.

Comparative Lubricant

As a comparative lubricant, use was made of the graphite-based mandrel bar lubricant PHOSPHATHERM® 120 GLW 30 (hereinafter "PH120") which is industrially used inter alia in the continuous process for the production of seamless tubes, from Chemische Fabrik Budenheim KG, which is in the form of a 30% suspension.

Lubricant Formulations and Raw Materials

Unless otherwise specified raw materials stated hereinafter were used in the lubricant formulations. All percentages are percents by weight and correspond to the details from the manufacturer.

Talc: chemical composition: $SiO_2$: 61.0%, MgO: 31.0%, $Al_2O_3$: 0.1%, $Fe_2O_3$: 1.8% and CaO: 0.6%; mean particle size (D50): 5 μm Phlogopite: chemical composition: $SiO_2$: 41%, $Al_2O_3$: 10%, MgO: 26%, CaO: 2%, $K_2O$: 10%, $Fe_2O_3$: 8%; mean particle size (D50): 44 μm Muscovite 1: chemical composition: $SiO_2$: 44%, $Al_2O_3$: 31%, $K_2O$: 9%, $Fe_2O_3$: 3%; mean particle size (D50): 45 μm Muscovite 2: chemical composition $SiO_2$: 51.5%, $Al_2O_3$: 27.0%, $K_2O$: 10.0%, $Fe_2O_3$: 2.9%, MgO: 2.8%; mean particle size (D50): 5 μm Graphite: natural graphite, carbon content: 95%, mean particle size (D50): 21 μm Adhesive: vinylacetate ethylene copolyer (EVA)

Thickener: xanthan gum (E415)

EXAMPLES

| | Optimum talc/layered silicate ratio | | | | | | | | |
|---|---|---|---|---|---|---|---|---|---|
| Formulation | PH120 | A | B | C | D | E | F | G | H |
| Water in % | | 75 | 75 | 75 | 75 | 75 | 75 | 75 | 75 |
| Talc in % | | 12 | 13 | 15 | 15.45 | 17 | | 10.5 | |
| Phlogopite in % | | 7.5 | 6.5 | 4.5 | 4.05 | 2.5 | 19.5 | | |
| Muscovite 1 in % | | | | | | | | | 19.5 |
| Adhesive in % | | 5 | 5 | 5 | 5 | 5 | 5 | 5 | 5 |
| Thickener in % | | 0.5 | 0.5 | 0.5 | 0.5 | 0.5 | 0.5 | 0.5 | 0.5 |
| Talc/mica ratio | — | 1.6 | 2 | 3.3 | 3.8 | 6.8 | — | — | — |
| Friction value (×1000) in μ | 73 | 57 | 49 | 44 | 45 | 51 | 49 | 55 | 63 |

FIG. 1 shows the friction values of the compositions investigated. Formulations C and D with a ratio of talc to phlogopite of 3.3 and 3.8 respectively presented the best results. Formulations B and E with a ratio of talc to phlogopite below 3.3 and above 3.8 respectively presented similar results to formulation F with phlogopite alone. Formulation A presented similar results to formulation G with talc alone. Formulation H, in which in comparison with formulation F the mica moscovite (moscovite 1) was used instead of phlogopite, presented markedly worse results than formulation F with phlogopite alone.

The friction values of al formulations A to H however were markedly lower than the comparative formulation PH120 with the graphite-based product in accordance with the state of the art.

Various amounts of solid lubricant of talc plus phlogopite

| Formulation | R | C | S | U | D | T |
|---|---|---|---|---|---|---|
| Water in % | 70.1 | 75 | 80.6 | 70.6 | 75 | 81 |
| Talc in % | 18.8 | 15 | 10.7 | 18.9 | 15.45 | 10.7 |
| Phlogopite in % | 5.6 | 4.5 | 3.2 | 5 | 4.05 | 2.8 |
| Adhesive in % | 5 | 5 | 5 | 5 | 5 | 5 |
| Thickener in % | 0.5 | 0.5 | 0.5 | 0.5 | 0.5 | 0.5 |
| Talc/mica ratio | 3.3 | 3.3 | 3.3 | 3.8 | 3.8 | 3.8 |
| Friction value (×1000) in μ | 56 | 44 | 42 | 56 | 45 | 42 |

FIG. 2 shows the friction values of the compositions investigated. With the ratio of talc to phlogopite in the range of 3.3 to 3.8 which was found to be particularly advantageous in respect of the achievable friction value, with about 13% talc plus phlogopite (formulations S and T), comparably good friction values as with 19.5% talc plus phlogopite (formulations C and D) were achieved. When using 26% and 25.24% talc respectively plus phlogopite (formulations R and U) the friction values were higher, but still always markedly lower than the comparative formulation PH120 with the product according to the state of the art on a graphite basis.

Comparison of various micas and addition of graphite

| Formulation | PH 120 | C | I | L | M | O | P | Q |
|---|---|---|---|---|---|---|---|---|
| Water in % | | 75 | 75 | 75 | 75 | 75 | 75 | 75 |
| Talc in % | | 15 | | 15 | 15 | 14.2 | 11.1 | 7.3 |
| Phlogopite in % | | 4.5 | | | | 4.3 | 3.4 | 2.2 |
| Muscovite 1 in % | | | | 4.5 | | | | |
| Muscovite 2 in % | | | | | 4.5 | | | |
| Graphite in % | | | 19.5 | | | 1 | 5 | 10 |
| Adhesive in % | | 5 | 5 | 5 | 5 | 5 | 5 | 5 |
| Thickener in % | | 0.5 | 0.5 | 0.5 | 0.5 | 0.5 | 0.5 | 0.5 |
| Talc/mica ratio | — | 3.3 | — | 3.3 | 3.3 | 3.3 | 3.3 | 3.3 |
| Friction value (×1000) in μ | 73 | 44 | 47 | 48 | 51 | 45 | 40 | 46 |

FIG. 3 shows the friction values of the compositions investigated. In the formulations L and M alternative micas muscovite 1 and muscovite 2 with phlogopite in formulation C and with the same use amount of pure graphite instead of talc plus mica in formulation I were compared. While with the same amount of phlogopite (formulation C) the best friction values were achieved, the micas muscovite 1 and muscovite 2 (formulations L and M) also presented good friction values which were only slightly above the use of the same amount of pure graphite instead of talc plus mica (formulation I).

In the formulations O, P and Q, in comparison with formulation C, a part of the amount of talc plus phlogopite was replaced while retaining the talc/phlogopite ratio=3.3 by 1%, 5% and 10% respectively of graphite.

The results show overall that with the lubricant according to the invention in comparison with commercially usual graphite-bearing lubricant and when using pure graphite or a proportion of graphite instead of talc plus mica, with the same use amount and the same layer thickness, the same or even markedly better lubricating effect can be achieved. With the lubricant according to the invention therefore considerable cost savings can be achieved in the production of seamless tubes in comparison with graphite-bearing lubricants used at the present time, and further disadvantages of graphite-bearing lubricants were overcome.

Comparison of various layer thicknesses

| Formulation | PH120 | PH120 | PH120 | C | C | C |
|---|---|---|---|---|---|---|
| Water in % | | | | 75 | 75 | 75 |
| Talc in % | | | | 15 | 15 | 15 |
| Phlogopite in % | | | | 4.5 | 4.5 | 4.5 |
| Graphite in % | | | | | | |
| Adhesive in % | | | | 5 | 5 | 5 |
| Thickener in % | | | | 0.5 | 0.5 | 0.5 |
| Talc/mica ratio | — | — | — | 3.3 | 3.3 | 3.3 |
| Layer thickness in g/m$^2$ | 60 | 80 | 100 | 30 | 50 | 80 |
| Friction value (×1000) in μ | 86 | 73 | 88 | 69 | 59 | 44 |

FIG. 4 shows the friction values of PH120 and the composition C with different layer thicknesses. The comparison of various layer thicknesses of formulation C with the comparative lubricant PH120 shows again that the formulation C according to the invention, even with the smallest use amount, with a layer thickness of only 30 g/m$^2$ still gives better or at least comparable friction values, in comparison with the comparative lubricant PH120 with double to more than three times the use amount.

The composition "C" used in the preceding comparisons contains 25% (wt %) of solid constituent and 75% water. In a further test higher levels of dilution of the same solid composition were produced with a lower solid proportion and friction value measurements were carried out as above (20% to 10% solid constituent; hereinafter "C20", "C17.5", . . . "C10")). With increasing dilution (increasing amount of water) and with the same application time the use amount (layer thickness) decreased in the test.

Comparison of various concentrations and layer thicknesses of the solid composition in accordance with "C"

| Formulation | PH120 | C(FS) | C20 | C17.5 | C15 | C12.5 | C10 |
|---|---|---|---|---|---|---|---|
| Water in % | | — | 80 | 82.5 | 85 | 87.5 | 90 |
| Talc in % | | 60 | 12 | 10.5 | 9 | 7.5 | 6 |
| Phlogopite in % | | 18 | 3.6 | 3.15 | 2.7 | 2.25 | 1.8 |
| Graphite in % | | 0 | 0 | 0 | 0 | 0 | 0 |
| Adhesive in % | | 20 | 4 | 3.5 | 3 | 2.5 | 2 |
| Thickener in % | — | 2 | 0.4 | 0.35 | 0.3 | 0.25 | 0.2 |
| Talc/mica ratio | — | 3.3 | 3.3 | 3.3 | 3.3 | 3.3 | 3.3 |
| Layer thickness in g/m$^2$ | 60 | — | 58 | 51 | 43 | 36 | 29 |
| Friction value (×1000) in μ | 86 | — | 38 | 52 | 65 | 64 | 60 |

C(FS) = percentage proportions related to the solid in composition "C" without water.

The results demonstrate that even with the sample "C10" with the highest level of dilution and the smallest amount of use, of only about half the amount with the lubricant according to the invention, considerably better friction values were still achieved than with the commercially usual graphite-bearing lubricant. A comparison of the results of this test with those of the preceding test shows that, for the solid composition "C" according to the invention, with a dilution of the order of magnitude of 20 to 25% and a use amount of about 50 to 80 g/m$^2$, particularly advantageous friction value results are achieved.

The invention claimed is:

1. A lubricant for the hot forming of metals, wherein the lubricant is an aqueous suspension containing, with respect to the solid constituents, at least the following constituents:

55 to 85 wt % of a solid lubricating agent comprising a mixture of talc and a potassium mica, wherein the ratio of talc to potassium mica in the solid lubricating agent is 2.0 to 5.0, 10 to 30 wt % of an adhesive agent selected from a polyvinyl acetate, sodium water glass and dextrin or a mixture of same, 2 to 10 wt % of a thickener selected from hydroxy cellulose, hydroxyethyl cellulose, hydroxyproply cellulose, carboxymethyl cellulose, methyl cellulose, ethyl cellulose, methylethyl cellulose, hydroxyethylmethyl cellulose, hydroxypropylmethyl cellulose, ethylhydroxymethyl cellulose, carboxymethylhydroxy cellulose, dextrin, starch, organically modified bentonite, smectite and xanthan gum, 0 to 10 wt % of further auxiliary agents, and not more than 10 wt % of graphite, wherein the lubricant, with respect to the solid constituents, contains 0 to 2.5 wt % boron-bearing compounds.

2. The lubricant according to claim 1, wherein the ratio of talc to potassium mica in the solid lubricating agent is 2.5 to 4.5.

3. The lubricant according to one of claim 1, wherein the potassium mica is selected from phlogopite, muscovite and a mixture of both.

4. The lubricant according to claim 1, wherein the potassium mica contains at least 60 wt % phlogopite.

5. The lubricant according to claim 1, wherein the lubricant contains 10 to 45 wt % solid constituents.

6. The lubricant according to claim 1, wherein the adhesive agent includes ethyl vinylacetate copolymer (EVA).

7. The lubricant according to claim 1, wherein the thickener includes xanthan gum.

8. The lubricant according to claim 1, wherein the lubricant as the remainder contains further auxiliary agents, wherein the auxiliary agents are selected from anti-foaming agent, dispersing agent and biocide.

9. The lubricant according to claim 1, wherein the lubricant with respect to the solid constituents, contains 0 to 1 wt % boron-bearing compounds.

10. A method comprising lubricating with said lubricant composition according to claim 1, at least one of a mandrel bar or a hollow block in the production of seamless tubes by hot forming of metals.

11. The method according to claim 10, wherein the lubricant is sprayed in the form of an aqueous suspension on to at least one of the mandrel bar or the hollow block in an amount of 30 to 150 g/m$^2$ sprayed surface area.

12. The lubricant according to claim 1, wherein the adhesive agent is ethyl vinylacetate copolymer (EVA).

13. The lubricant according to claim 1, wherein the thickener is xanthan gum.

* * * * *